United States Patent [19]

Bostroem

[11] 4,026,491

[45] May 31, 1977

[54] WINDER DRUMS FOR STRIP SLITTING LINES

[76] Inventor: Theodore Bostroem, 470 Park Road Extension, Middlebury, Conn. 06762

[22] Filed: Dec. 31, 1975

[21] Appl. No.: 645,652

[52] U.S. Cl. ..... 242/72 B; 242/56.9

[51] Int. Cl.[2] ..... B65H 75/24

[58] Field of Search ..... 242/56.9, 72, 72 B; 279/2

[56] References Cited

UNITED STATES PATENTS

| | | | |
|---|---|---|---|
| 3,010,671 | 11/1961 | Brown | 242/56.9 |
| 3,878,999 | 4/1975 | Daves | 242/56.9 |
| 3,904,143 | 9/1975 | Kullander | 242/72 B |
| 3,904,144 | 9/1975 | Gattrugeri | 242/72 B |

*Primary Examiner*—Edward J. McCarthy
*Attorney, Agent, or Firm*—Donald D. Jeffery

[57] ABSTRACT

Apparatus for winding a plurality of metal strips on a non-collapsible drum to form a plurality of coiled strips. In one form of the invention, the drum is formed with spaced slots in the periphery thereof in which are positioned rail members and interconnected wear members. Core members are positioned loosely around the periphery of said drum for receiving the individual slit strips, and expansible hoses are positioned in each slot radially inwardly of the rail. Fluid pressurization of the hoses functions to expand the same and force said rail and wear members radially outwardly into frictional contact with the core means thereby creating tension in said metal strips and consequent tight winding of the narrow strips on the core means. The pressure can be partially reduced to permit the tightly wound strip coils to slip on the drum surface and the loosely wound strips to continue rotation so as to remove the slack from the strips, thereby compensating for unequal thicknesses of the marginal and median strips. In a further form of the invention, the hoses are positioned in the drum for direct pressure contact with the core members.

23 Claims, 21 Drawing Figures

FIG. 6
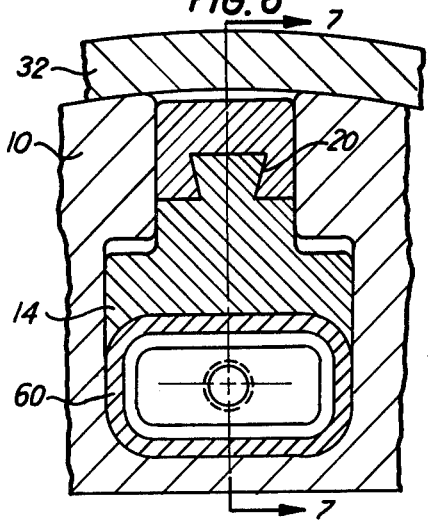
FIG. 7
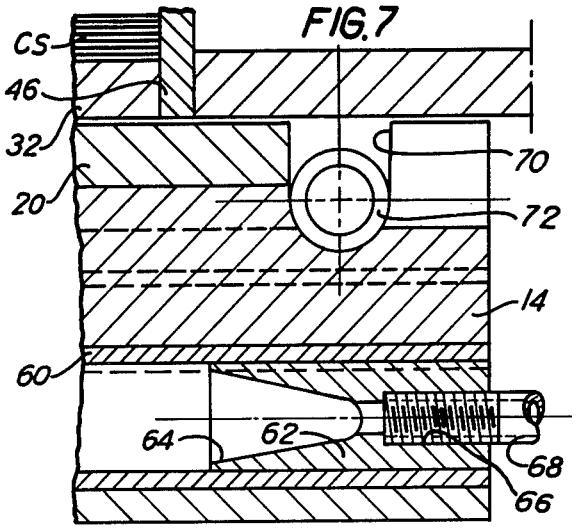
FIG. 8
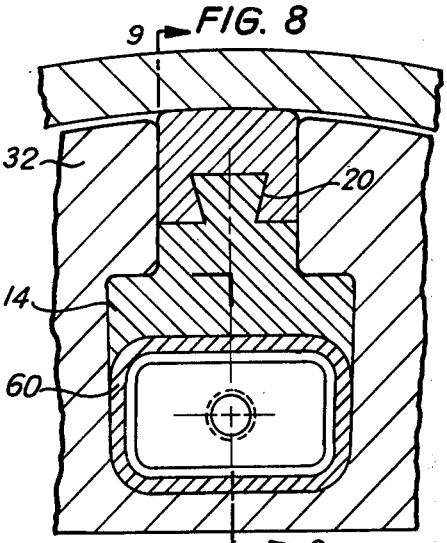
FIG 9
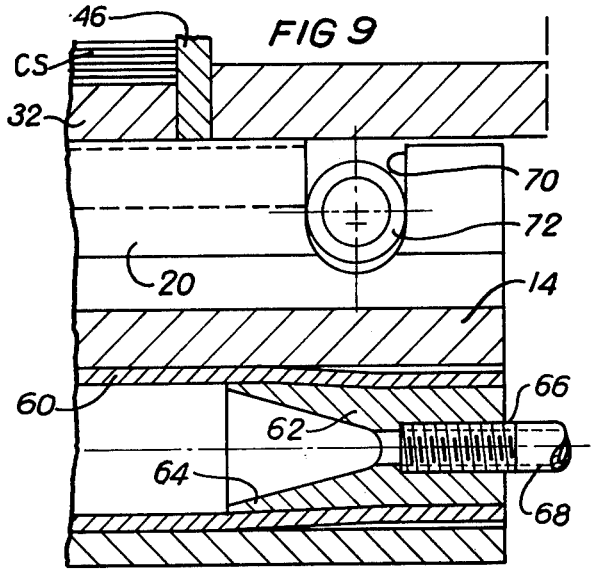
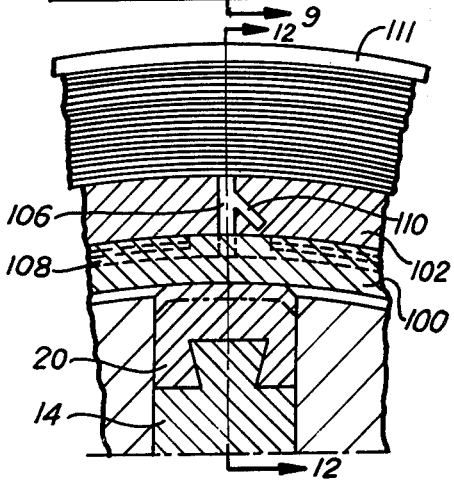
FIG. 11
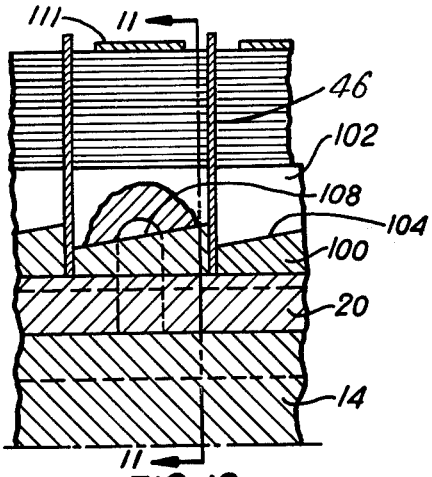
FIG. 12

WINDER DRUMS FOR STRIP SLITTING LINES

BACKGROUND OF THE INVENTION

The present invention relates as indicated to winder drums for strip slitting lines, and relates more particularly to winder drums so constructed and arranged that the strips are wound tight on the drums regardless of the difference in thickness or gauge between the strips to be wound on the drums.

A problem universally recognized in the winding of strip material, for example strip steel, is the inability to uniformly wind the several strips onto the winder drums due to the lack of uniformity in thickness of the formed strips. Frequently, the original, relatively wide, steel strip from which the strips are slit is crowned, that is, it tapers from a greatest thickness at the transverse center of the strip to a thinner gage at the marginal portions of the strip. Thus, unless the thickness differences are compensated for, the marginal strips do not build up in the same uniform manner as the strips slit from the center portion of the plate, thereby resulting in loose strips corresponding to the strips formed at the marginal portions of the original, wide strip. Since it is highly desirable to wind or build up the strips into relatively tight coils on the drums, resort has been made to fillers of various types, including special cardboard, or the like, which are manually inserted into the marginal strips in order to avoid loosely hanging strips and to provide the desired tight buildup of the strip on the drum. This procedure is not only highly labor-consuming but also physically dangerous to the workers, and the presence of fillers in the coiled strips presents certain disadvantages to the ultimate consumer.

In recognition of such problem, there have been numerous attempts in the prior art to provide apparatus for coiling slit strips with uniform tension, with most of these devices being mainly concerned with the winding of paper and plastic strip material. Due to the vastly greater forces involved in the winding of strip steel, most of the prior art devices for winding paper and plastic are inadequate. The winding devices in the prior art for winding metallic strip are extremely complicated and are frequently limited to a particular strip width.

Reference will now be made to known prior art devices for tensioning slit strip material, with such art, however, not fully satisfying the problems referred to above. U.S. Pat. No. 3,061,226 to V. J. Kegg discloses a device for applying extra tension to the marginal metal strips but is applicable only to relatively small coils. One known example of the inability of the Kegg device to handle large coils is an instance in which the loose strips for a large coil hung down 15 feet, representing 30 feet of loose strip. Moreover, the rollers which supply such additional tension to the strips have to be changed in accordance with the width of the strips, and the device has the further disadvantage that it needs a relatively expensive collapsible coiler.

U.S. Pat. No. 3,853,280 to Joseph V. Pennisi et al. discloses a winding mandrel which compensates for unequal thicknesses in the material by imposing a limiting torque condition on each core. However, the disclosed apparatus is for the particular purpose of winding pressure-sensitive adhesive tape wherein very low tension conditions exist, and the construction of the mandrel is such that it would not be satisfactory for winding individual steep strips with uniform tension.

U.S. Pat. No. 3,878,999 to Howard W. Daves also discloses winding apparatus for maintaining equal winding tension of a plurality of strips wound simultaneously on individual cores. However, the mandrel is comprised of individual sections each of which is independently contained and actuated, and the device is limited to certain fixed size strip widths, or multiples thereof.

Other prior art known to applicant alluding generally to the problems outlined above are U.S. Pat. Nos. 3,188,016 to C. Aaron; 3,552,672 to Karl E. L. Grettve; 3,592,405 to Michael M. Young and 3,817,468 to Albert E. Smolderen et al. However, these relating to winding devices primarily designed for winding paper or plastic material, or are structurally quite dissimilar from the present invention.

SUMMARY OF THE INVENTION

With the above in mind, the principal object of the present invention is to provide a safe and simple winder system for metal strips which effects winding of the strip in substantially uniformly tight coils for each strip regardless of the differences in thickness between the strips, and for any combination of strip widths, producing a pull proportional to the strip width. The need for providing fillers in the off gage strip coils is thereby eliminated. A related object is to accomplish such uniform tensioning automatically and without the use of manual labor, and under totally safe conditions.

The invention briefly described may comprise a solid drum shaft provided with equally spaced longitudinal slots which are generally T-shaped in cross section. Located in the slots are resilient rails and interfitted wear pieces which can extend slightly radially beyond the drum periphery. A plurality of spaced cores, each one corresponding to the width of its strip, are disposed around the drum, with the interior diameter of the cores being somewhat larger than the outside diameter of the drum surface so as to permit rotation of the cores relative thereto.

After the leading ends of the slit strips have been fixed onto the respective cores, radially outward pressure is applied to the rails, preferably by a fluid pressure source, thereby creating pressure contact between the wear members and the core whereby tension is transmitted to the strips thereby resulting in the strips being tightly wound around the cores.

During the winding process, the fluid pressure on the rails can be periodically reduced thereby allowing the tightly wound coils to slip somewhat with their cores on their supporting rails and allowing the loose coils to "catch up" with the tight coils, after which the full fluid pressure is again applied to produce the desired tightly wound coils. To compensate for the variations in the interior diameter of the cores the rails are preferably flexible in a radial direction, for example, by imbedding into the rails, which are preferably made of hard rubber, a spring or similar reinforcing element allowing some flexibility in the radial direction.

As above noted, it is mainly the marginal strips that have a reduced thickness, and in order to make more efficient the regular winding operation, it is proposed to have the cores supporting the marginal strips of slightly larger outside diameter so as to result in slippage of these cores rather than the cores which support the median strips. If the number and gage deviation of the marginal strips are known, the outside diameter of the marginal cores can be calculated so that at the end of the coiling operation, the outside diameter of the marginal coiled strips is equal to that of the median coils. If more than one marginal coil at each side of the winding apparatus requires such compensation, the inner marginal coil will need less compensation than the outer marginal coil. While the present description refers to "marginal" strips, it will be understood that any off-gage strip coil can be tightly wound in accordance with the present invention.

The fluid pressure applied to the cores to properly tension the strips can be varied according to the strip tension desired to be obtained, with heavier gage strip requiring the application of greater tension. In addition, in order to obtain a uniform tension during the entire coiling operation, it is necessary to increase the torque on the winder and, in order that the cores transmit more friction to the coiled strips, it is necessary to correspondingly increase the fluid pressure in proportion to the variation of the coil diameters. Adjustment and regulation of the fluid pressure is accordingly necessary to most efficiently produce the desired result.

BRIEF DESCRIPTION OF THE APPLICATION DRAWINGS

FIGS. 1A and 1B comprise separated longitudinal cross sectional views taken on line 1—1 of FIG. 2. The figures are identical except in FIG. 1A the cores are somewhat smaller than the width of the slit strips and ring spacers are positioned therebetween, whereas in FIG. 1B, the cores are the same width as the slit strips and thin discs separate the coiled strips and the cores from each other;

FIG. 6, is a sectional view similar to FIGS. 4 and 5, showing a modification of the invention;

FIG. 7 is a sectional view taken on line 7—7 of FIG. 6;

FIG. 8 is a sectional view similar to FIG. 6, showing, however, the components under conditions of fluid pressure appliction;

FIG. 9 is a sectional view taken on line 9—9 of FIG. 8;

FIG. 11 is a vertical sectional view of a further modification of the invention, taken on line 11—11 of FIG. 12;

FIG. 12 is a sectional view taken on line 12—12 of FIG. 11;

DETAILED DESCRIPTION OF THE PREFERRED EMBODIMENTS

Figure 1B:
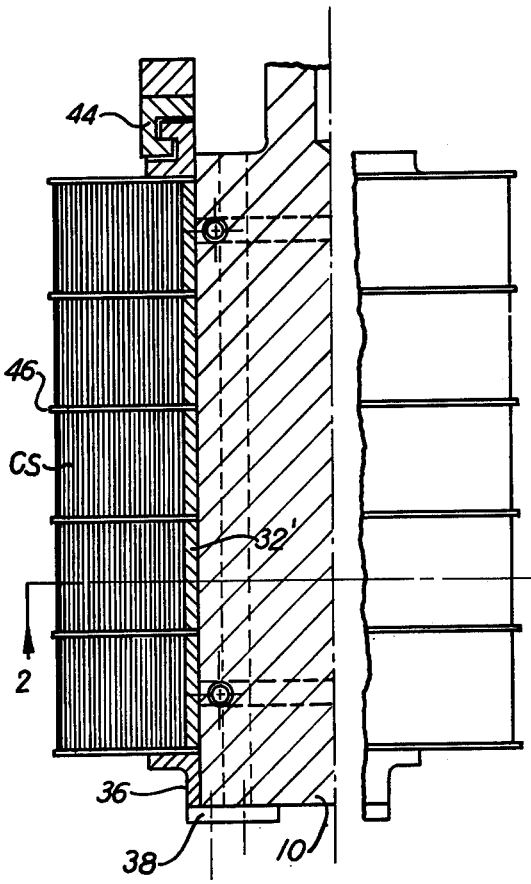

Referring now in more detail to the application drawings, wherein like parts are indicated by like reference numerals, the drum shaft is generally indicated at 10 and is formed with a series of circumferentially spaced, longitudinally extending generally T-shaped slots commonly designated at 12. In the form of the invention illustrated in FIG. 2, there are six such slots formed in the drum 10, and flexible rails 14 are mounted in each slot. The rails are preferably formed of hard rubber material so as to provide resilient flexibility when fluid pressure is supplied to the lower surface thereof as will be explained hereinbelow. Each rail is formed with tongue 16 at the upper end thereof which engages a groove 18 formed in the wear member 20 which may comprise a single member coextensive in length with the rail 14, or a series of members of shorter lengths.

Mounted in the slot 12 below the rail 14 is a flexible hose 22 which communicates with a fluid distributing head 24 which in turn communicates through lines 26, only one of which is visible in FIGS. 1A-B, to a bose 28 formed in the shaft. Hydraulic fluid under pressure is supplied to the bore 28 for distribution to the header 24 and thus to the hydraulic hoses 22 positioned in each slot.

Figure 5:
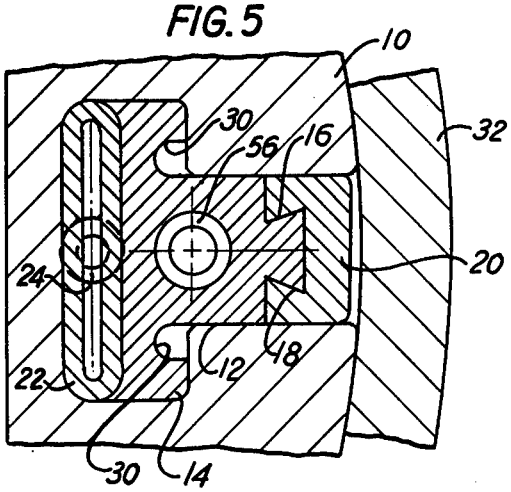
FIG. 5 is a fragmentary sectional view similar to FIG. 4, in the absence of fluid pressure.
Figure 4:
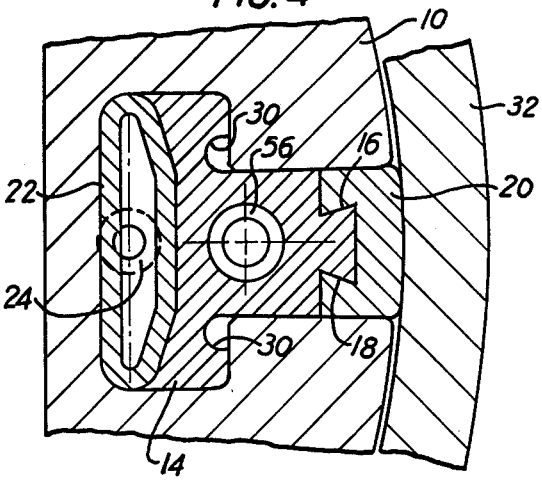
FIG. 4 is an enlarged view of a portion of FIG. 2, showing fluid pressure application to the rail and the wear member extending radially beyond the periphery of the drum shaft.

Each rail 14 is formed with grooves 30 adjacent the stem portion of the rail, with FIG. 5 showing the grooves 30 in an unstressed position corresponding to the absence of fluid pressure supplied to the hose 22. In such position of the rail, the radially outer surface of the wear member 20 extends slightly below the outer peripheral surface of the drum 10. When fluid pressure is applied to the hose 22, referring to FIG. 4, the rail 14 extends radially beyond the outer surface of the drum 10 for frictionally engaging the surrounding core member as will be presently described, and the grooves are constrained as shown in FIG. 4. Release of the fluid pressure results in radial inward movement of the rail due to the flexibility thereof.

Figure 1A:
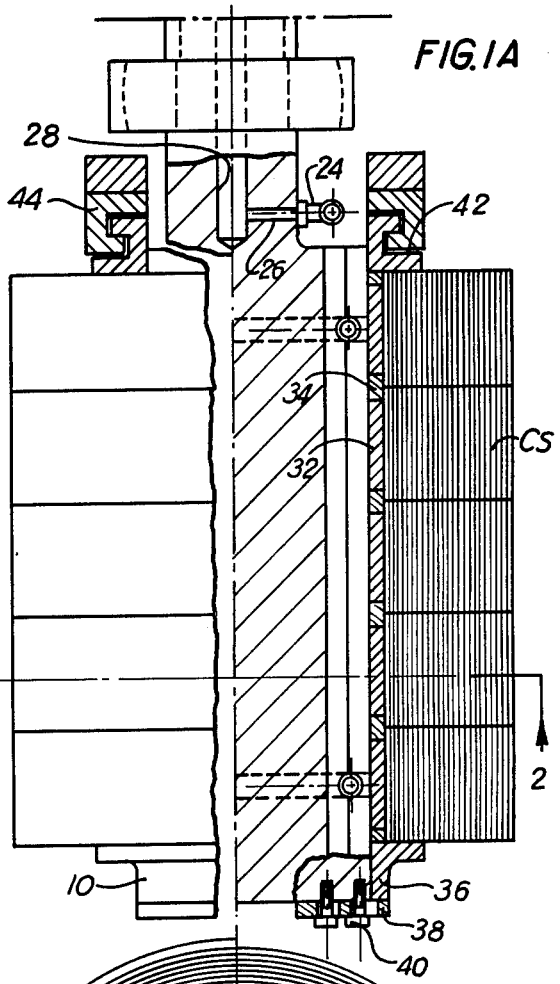

Disposed around the periphery of the drum 10 are individual core members commonly designated in FIG. 1A at 32. In this figure the core members are slightly less in width than the coiled strip which is designated at CS. Spacers 34 are positioned between the core members 32, and the assembly of core members and spacers are secured in place by an end ring 36 which is generally L-shaped in cross section. The end ring is retained on the drum by means of keepers 38 which are apertured to receive mounting bolts 40 which extend into threaded openings in the drum. At the opposite end of the assembly, a stripper member 42 extends around the outer end of the drum, and a plurality of lugs commonly indicated at 44 retain the keepers in place in a manner well understood by those in the art.

It will be understood that the core members 32 and spacers 34 are annular and extend completely around the drum 10. However, in order to illustrate an alternative form of the invention, FIG. 1B illustrates a slightly different form of core member and spacer, with FIG. 1B being otherwise identical to FIG. 1A. In FIG. 1B, the core members 32′ are approximately the same width as the coiled strips, and are separated by spacers in the form of relatively thin discs 46.

Figure 2:
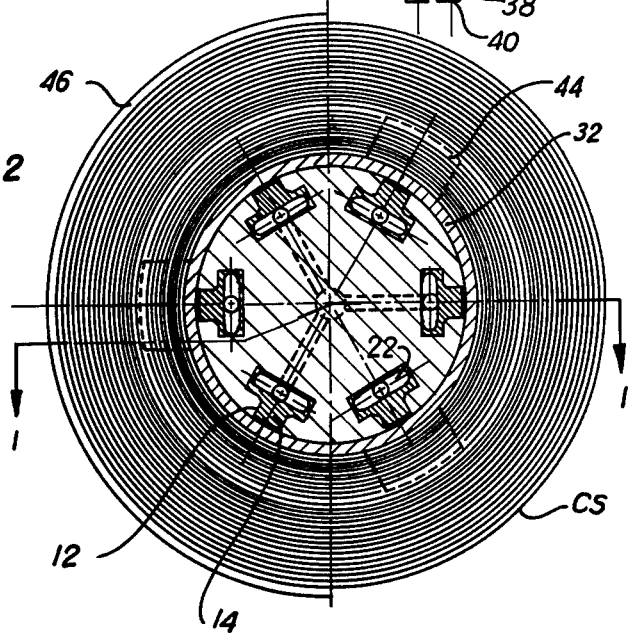
FIG. 2 is a vertical sectional view taken on line 2—2 of FIGS. 1A-B.
Figure 3:
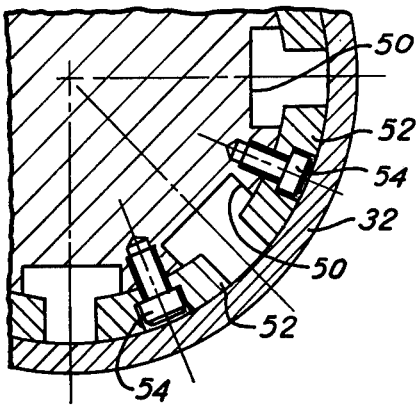
FIG. 3 is a fragmentary vertical sectional view generally similar to FIG. 2, showing a modified form of the invention in which the T-shaped slots are formed by segments attached to the drum shaft.

FIG. 3 illustrates a modified form of the invention in which the generally T-shaped slots are formed by covering rectangular slots 50, formed in space relation circumferentially around the drum, by arc-shaped segments 52 which are mounted on the drum by bolts 54. In FIG. 3, there are eight T-shaped slots thus formed, as compared with six slots as shown in FIG. 2, and it will be understood that the number of slots can vary in accordance with the invention, For example, from 3 to 30 slots can be provided for this embodiment, with 18 slots operating satisfactorily in practice.

Referring to FIGS. 4 and 5, a rail reinforcing member, for example, a spring 56, or a chain (not shown) is embedded in the hard rubber rail for reinforcing the same but without affecting the flexibility characteristics of the rail thereby not impairing radially inward movement of the rail upon cessation of fluid pressure. The flexibility of the rail accommodates small variations in the interior diameter of the cores thereby assuring a force on each core proportional to the core and strip widths.

Referring to FIGS. 6–9, the form of the invention illustrated therein generally resembles the form previously described, and where appropriate, the same reference numeral has been applied. In the FIGS. 6–9 form, the hose 60 is retained in a partially expanded position as shown in FIG. 6 by an end piece 62 having a tapered leading end portion 64. The end piece 62 is threaded as shown at 66 for receiving a tube 68 by means of which fluid can be supplied under pressure to the interior of the hose. The drumshaft 10 is formed with an annular recess 70 formed in the outer periphery of the drum shaft and extending transversely to the length of the drum, with an annular garter spring 72 being positioned in the groove 70 for continually biasing the rail 14 to its radially inward position as shown in FIG. 6. In such position, the hose 60 is in its constricted position, in the absence of application of fluid pressure to the hose through the fluid line 68. Although hydraulic fluid is the preferred source of pressure, it will be understood that a gas pressure system could also be employed.

When fluid under pressure is supplied to the hose 60, referring to FIGS. 8 and 9, the hose expands and forces the rail 14 and wear member 20 radially outwardly into pressure contact with the core member 32 in the same manner as above described, with such radial outward movement being against the bias of spring 72. When the fluid pressure is reduced or eliminated, the spring 72 forces the rail 14 radially inwardly so that the outer surface of the wear member is positioned within the periphery of the drum shaft 10 and thus below the interior diameter of the core 32, as shown in FIGS. 5 and 6.

Figure 10:
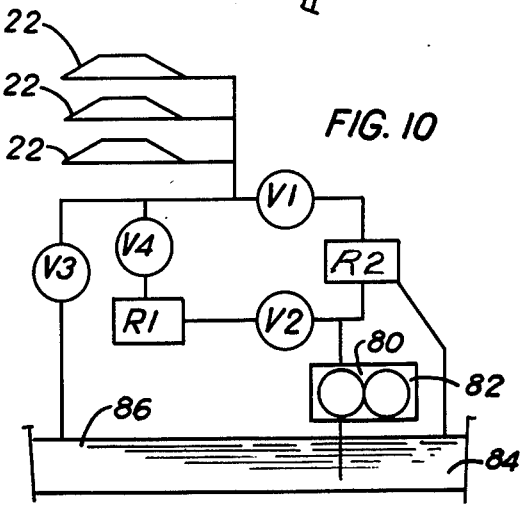
FIG. 10 is a diagrammatic showing of the hydraulic system in accordance with the invention.

Referring to FIG. 10, the hydraulic control system for the invention is illustrated therein and it comprises a pressure tank 80 and pump 82 both of which are shown schematically, with the inlet of the pump being fed from a tank 84 containing the hydraulic fluid 86. A plurality of valves V1, V2, V3 and V4 of the "close-open" type are provided, and pressure regulating valves R1 and R2 form part of the system, and the expansible hoses 22 are shown schematically in FIG. 10.

The hydraulic control system of FIG. 10 is designed to produce three conditions, namely, the hoses deflated, the hoses under full pressure, and the hoses under reduced pressure with the latter condition enabling, during the winding operation, the cores of the loose slit coils to catch up with the relatively tight wound coils.

The following table shows the position of the various valves during the above described operating conditions;

| Condition | Valve No. V1 | V2 | V3 | V4 |
|---|---|---|---|---|
| a Hose deflated | C | C | 0 | C |
| b Hose full pressure | O | C | C | C |
| c Pressure reduced | C | O | C | O |

The letter "O" in the table means open and "C" closed. The pressure regulating valve R1 regulates the pressure necessary to produce slippage of the coils, whereas regulating valve R2 regulates the main pressure to the hoses in accordance with the buildup of the strip around the cores.

The slit strip is mounted on the cores in accordance with the present invention as follows. After placing the cores 32 on the drum shaft and locking the same in place, the ends of the strips are fixed to their respective cores by any suitable means such as tape or the like. The hydraulic control system is thereafter adjusted so that the pressure of the hydraulic fluid supplied to the hoses is reduced. The drum shaft is thereafter rotated so as to equalize the tension on the strips. The control system is thereafter adjusted to place the hoses under full fluid pressure and the entire system is thereafter switched to automatic controls, which are not shown but which are well known in the art, which controls periodically shift the pressure between the above described conditions *b* and *c*, wherein the pressure is full or reduced, respectively. A commercial timing switch can be provided so as to obtain the desired periods of shifting back and forth between such conditions. By changing between such conditions of full and reduced pressures, uniform tension can be applied to the several strips by permitting certain of the cores to undergo slippage as above described. When the strip has been completely wound onto the cores, the ends of the strip may be immobilized and a signode strapping 111, FIG. 12, may be applied to the narrow coiled strips while they are still in winding position on the drum and the hydraulic system is in either position b or c as above described. The tight coils supported from the inside of the cores and from the outside held firmly by the signode strapping can then be removed after deflating the hydraulic hoses.

It will be noted that the procedure for assembling the cores on the drum will vary somewhat if the arrangement shown in FIG. 1B is employed. In that form of the invention, a single core 32′ and spacer 46 are positioned around the drum and the strip secured to the core. The next core and spacer are thereafter positioned and the strip fixed to such core, until all the cores and spacers are in place.

It will be understood from the foregoing description that the coiled strip and supporting core are removed from the drum and thereafter handled as a single product for shipment. When the strip has been unwound by the purchaser, the core remains, and should, in view of the cost thereof, be returned by the customer for further use. This handling of empty cores does present a problem and frequently not all cores are returned.

The provision of cores which can be removable from the coiled strip prior to shipment would for the above reasons be desirable, and FIGS. 11–12 illustrate such a modification. It will be noted, referring to FIG. 12, that the spacer discs 46 correspond to the spacers 46 as illustrated in FIG. 1B.

The supporting core in the FIGS. 11–12 form actually comprises a pair of core elements, an inner solid core member 100 and an outer core ring 102, with both the solid core 100 and the core ring 102 being formed with mating, tapered surfaces the interface of which is shown at 104. The core ring 102 is a split ring, with a gap 106 separating the adjacent ends of the ring.

The core ring 102 is formed on its inner tapered surface with a groove 108 which extends continuously around the ring and terminates just short of the adjacent ends thereof, as can be seen in FIG. 11. Groove 108 is in fluid communication (by means not shown) which a commercially available high pressure hydraulic control system whereby fluid pressure can be applied to the groove 108, thus allowing the inner ring 100 to "pop" out or slide transversely relative to the core ring 102, with such sliding movement being effected by virtue of the tapered mating surfaces of the members. Once the inner core 100 has been displaced, the gap 106 in the core ring 102 closes thereby reducing the diameter of the ring and freeing the same from the internal diameter of the coiled strip CS.

Figure 14:
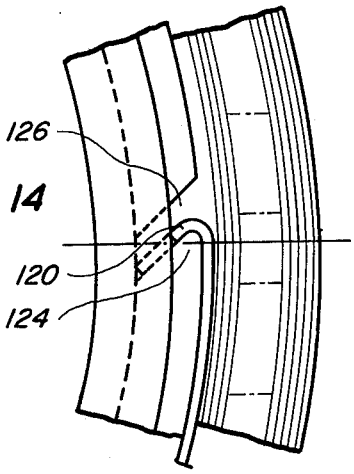
FIG. 14 is an enlarged fragmentary view showing a modified form of securing the leading end of the strip to the split outer ring.

The facilitate fixing the leading ends of the strip onto the core ring 102 prior to the winding operation, one end of the slit core ring 102 can be formed with a groove 110 which communicates with the gap 106 when the core ring is positioned around the solid core 100, whereby the leading end of the strip can be bent down over the edge of the core ring into the groove 110. Since such bending exceeds 90°, the strip is prevented from jumping out of the groove prior to sufficient strip buildup which inherently fixes the leading ends of the strip in place on the split core ring. The same result can be achieved by beveling the gap of the core ring as shown in FIG. 14 to permit the same bending effect of the leading edge of the strip.

Although the two piece core assembly of FIGS. 11–12 is greater in initial cost than the one piece core previously described, the two piece core assembly is immediately removable from the coiled strip thereby eliminating the problem of handling of the empty cores and consequently reducing the number of cores required. When the two part core assemblies are used, the end rings and keepers which maintain the cores and coil strips in place must be of sufficient strength to withstand the eventual longitudinal force developed during the buildup of the coil acting radially on the tapered contact surface between the solid core and the core ring.

Figure 13:
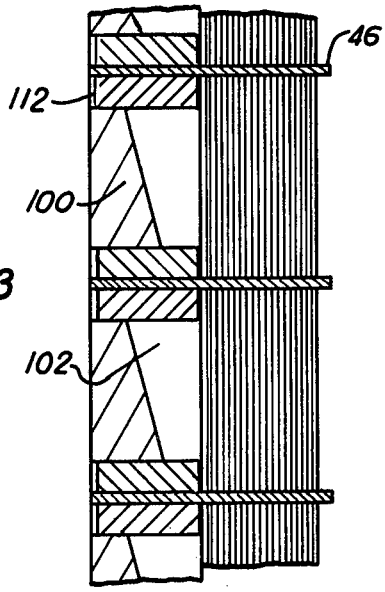
FIG. 13 is a fragmentary view similar to FIG. 11, showing a modified form of core and spacer assembly.

It will be understood from the foregoing description that core members of different widths can simply and quickly be assembled on the drum shaft, which is a decided advantage. The form of the invention illustrated in FIGS. 11–12 provides the further advantage in that the cores can be quickly removed from the drum shaft after coiling, and immediately reused. FIG. 13 discloses a form of the invention similar to FIGS. 11 and 12, differing therefrom by the further provision of additional spacing means and having core members which are proportionally less in width. In FIG. 13, the inner, solid core ring 100, the outer split core ring 102 and the spacers 46 have been designated by the same reference numerals as previously applied. It will be noted that in FIG. 13, however, that the core members 100 and core rings 102 do not extend fully between the spacer discs 46, but are spaced therefrom by supplemental spacing members commonly designated at 112 which are positioned on either side of each disc 46. The inside diameter of each spacer element 112 is slighly larger than the inside diameter of the core member 100, and the outside diameter of the spacer elements 112 is preferably slightly smaller than the outside diameter of the core rings 102. It will thus be seen that the core members in combination with the supplemental spacing members 112 can accommodate varying widths of strip without requiring the replacement of core members of comparable width as the strip to be wound thereon. For example, to accommodate a strip 2 inches in width, the core members can be 1.75 inches in width and each supplemental spacing member ⅛ inch in width thereby achieving a total width equal to the width of the strip. If the width of the strip is 2.25 inches, the same core members are employed but with supplemental spacing members ¼ inch in thickness, with the supplemental spacing members on either side of the core members making up for the width differential between the core members and the width of the strip. In this manner, core members of a common, predetermined width can be employed with strips equal to or substantially greater in width than the width of the core members by employing spacer members having the necessary thickness.

The inner core members 100 and outer core rings 102 are separated in the same manner previously described in reference to the FIGS. 11–12 form of the invention, and the supplemental spacing members 112 likewise can be immediately removed from the strip coils for use with the removed cores for subsequent operation. This, coupled with the wide adaptability of the FIG. 13 form of the invention for strips having varying widths, permits use of the invention on a wide spread, almost universal basis.

FIG. 14 is similar to a portion of FIG. 11, showing a somewhat different arrangement for engaging the leading end of the strip in the outer split ring for retention of the strip on the core assembly. The leading end of the strip is designated at 120 and is reversely bent over the shoulder 124 which partially defines the gap 126 formed in the outer split ring 102.

In all of the above described and illustrated forms of the invention, interconnected rail and wear members are employed for frictional contact with the core means for creating tension in the metal strips and consequent tight winding of the strips on the core means. FIGS. 15–20 illustrate modifications of the invention in which the rail and wear members are eliminated and replaced by members which when inflated, directly engage the core members thereby creating the necessary frictional contact as above described.

Figure 15:
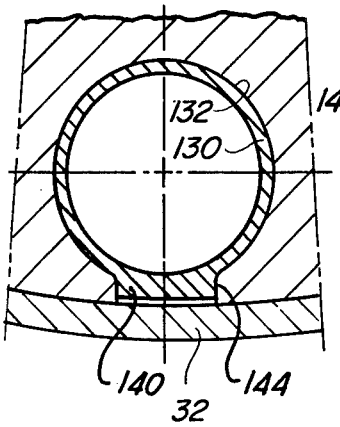
FIGS. 15–17 are fragmented cross-sectional views of further modified forms of the invention in which pressure is applied to the core directly by inflatable hoses.

Referring initially to FIG. 15, an enlarged hose member 130 is mounted in an opening 132 therefor in the drum, with the hose member having an extending or boot portion 140 positioned in a slot or groove 144 formed in the outer periphery of the drum. When pressure is applied to the interior of the hose member 130, for example, by the control system previously described, the boot 140 is moved radially outwardly into contact with the core member 32 thereby creating frictional resistance to the rotation of the core member. When the pressure on the hose member 130 is withdrawn, the boot 140 moves away from contact with the core member thereby eliminating the frictional drag on the core member and permitting subsequent removal of the strip carrying cores which are pushed off the drum by the stripper.

Figure 16:
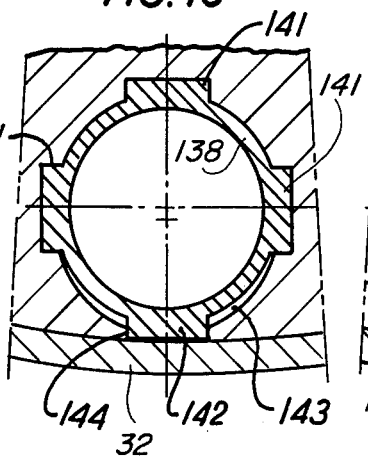

Referring to FIG. 16, this form of the invention comprises an inflatable hose member 138 formed with three circumferentially spaced boots 141 and a fourth boot 142 which extends through opening 144 in the drum. The drum is of course shaped to receive the boots 141 which function to maintain the expansible hose member in proper position and prevent rotational movement of the member relative to the drum. When pressure is applied to the hose member, the boot 142 expands outwardly into frictional contact with the core 32, and when the pressure on the hose member 138 is withdrawn, the boot 142 retracts thereby allowing rotation of the core member relative to the drum.

It will be noted that the drum is formed with a slightly eccentric opening for receiving the inflatable hose member so as to provide a small clearance 143 adjacent the boot 142, with the clearance 143 being provided so that the drum does not interfere with the radial movement of the boot 142 into and out of engagement with the core 32 whereby torque can be transmitted by the drum to the core.

In the FIG. 16 form, any number of boots 141, 142 can be provided, but four is the preferred number. When a boot becomes worn due to repeated frictional contact with the core 32, the expansible hose can be rotated 90° so as to reposition a fresh boot into the opening 144. The boots of course slide radially relatively loosely in the opening 44 so as to not impair the radial expansion of the boots.

Figure 17:
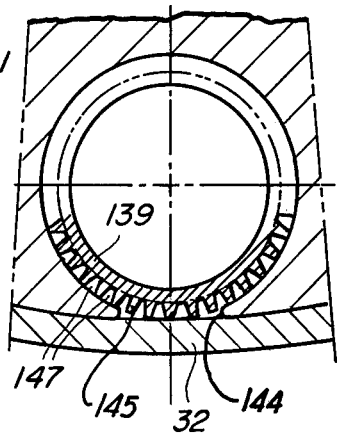

Referring to the FIG. 17 invention form, the inflatable hose member 139 is formed with a continuous series of ribs or ridges 145 on the exterior surface thereof, with the ridges or ribs shown lowermost in FIG. 17 extending through the opening 144 into pressure contact with the core 32. To prevent rotation of the hose member 139 relative to the drum opening 146, the latter is likewise formed with a series of ribs 147, with the ribs of the inflatable member and drum opening interfitting to prevent relative rotation of the hose member. When the ribs 145 which extend through the ribs 144 become worn, the hose member can be rotated to present a fresh series of ribs to enhance the pressure contact with the drum. To facilitate radial expansion of the ribs 145 into pressure contact with the core 32, the opening 144 may be made somewhat wider and shallower than illustrated in FIG. 17.

Figure 18:
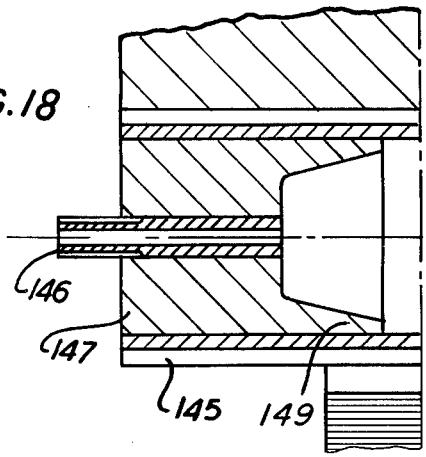
FIGS. 18 and 19 are fragmentary sectional views at right angles to the plane of the sectional views of FIGS. 15, 17
Figure 19:
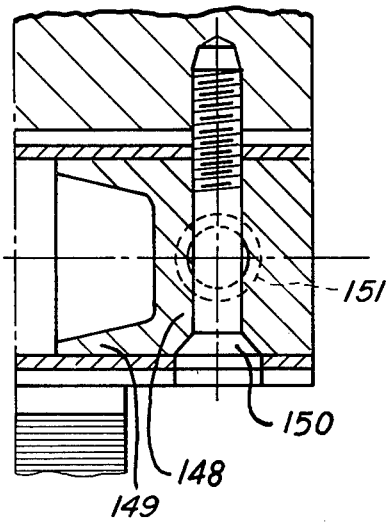

FIGS. 18 and 19 comprise longitudinal sectional views showing the inflatable hose ends. In FIG. 18, the fluid feed end, a pipe 146 is embedded in a solid end piece 147 positioned in the drum, with the latter being generally cup shaped at the end thereof and formed with lips 149 which represent the various hose shapes shown in FIGS. 16–17.

In FIG. 19, a solid blind end member is shown at 148, and a screw 150 is shown extending through the end member 148 into threaded engagement in the drum so as to immobilize the hose longitudinally in its groove. An opening 151 is formed in the end piece for the screw, and a plurality of such openings are preferably formed at 90° with respect to each other, with a second such opening being shown in dashed lines in FIG. 19. In this manner, when the hose of FIG. 16, for example, is rotated 90°, the end piece 148, subsequent to such rotation, can again be immobilized by inserting the screw 150 through an opening 151 also spaced 90° from the opening shown in FIG. 19.

Figure 20:
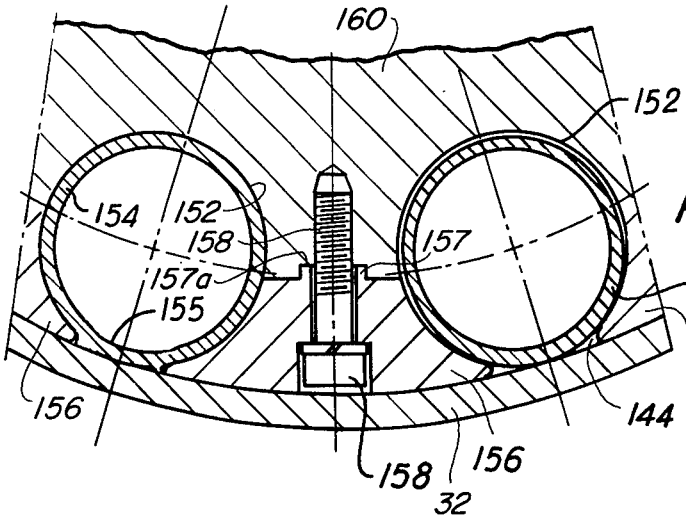
FIG. 20 is a fragmentary sectional view of another form of the invention in which the inflatable hoses are retained by bar members secured to the drum.

Referring to FIG. 20, in this form of the invention inflatable hose members 153 and 154 are shown mounted in semi-cylindrical slots or openings 152 formed in the drum 160 which is shown radially abbreviated in this figure. At the location of each pair of hoses, a shaped bar 156 is provided, secured to the drum 160 through bolts 158. The bar 156 is formed with a tongue 157 which fits into a groove **157*a* formed in the drum to facilitate positioning of the bar relative to the drum. The bar 156 is formed with curved surfaces at the side thereof which conform in radius to the openings 152 in the drum so as to provide a cylindrical opening for the inflatable hoses 153 and 154**.

Hose 153 is shown in a non-inflated position in FIG. 20, and hose 154 is shown inflated, with the section 155 of the hose extending through opening 144 into pressure contact with the core 32. The openings 144 are defined by a pair of adjacently disposed bar members 156.

It will thus be seen that FIG. 20 represents a simplified version of the concept common to all the FIGS. 15–20 forms of the invention, even through in this form as well rotation of the inflatable hoses relative to the drum is prevented. When pressure is applied to the hose, for example by hose 154 in FIG. 20, the same pressure acts not only on the section 155 which contacts the core 32 but also on all other surfaces of the hose, and since the surface area upon which the hose acts is several times the surface area of the section 155 which extends through the opening 144, there is no danger of rotation of the hoses in the cylindrical opening provided therefore in the drum section and by the bars 156. The FIG. 20 form of the invention has the further advantage that a smaller and therefore less expensive drum body can be provided.

In the FIGS. 15–20 forms of the invention, the size of the drum, and the number and size of the hoses can be selected as necessary. For example, the outside diameter of the drum can be 16 inches, and the round hoses 1.5 inches outside diameter and 1.25 inches inside diameter. A typical winder drum could comprise 24 hoses in all, spaced circumferentially around the drum although a fewer number of hoses and corresponding drum openings could suffice.

Although the function of the FIGS. 15–20 forms of the invention has been described in terms of full pressure or no pressure on the hoses, it will be understood that conditions of partial reduction of pressure can also be provided thereby permitting the tightly wound coil strips to slip on the drum surface and the loosely wound coiled strips to continue rotation so as to remove the slack from such strips, so as to form uniformly tight wounded coiled strips.

It will be noted that modifications in the invention just described will be apparent to those skilled in the art, without however, departing from the invention concepts. For example, any known source of fluid pressure can be applied to the rail members for radially outward expansion thereof. Although a hydraulic control system has been illustrated in FIG. 10 for such purposes, the fluid pressure could be pneumatically derived. Similarly, although the core members 32 are illustrated as being constructed of metal, it will be apparent that plastic or other types of materials, for example relatively thick, strong paper, could be provided as long as the characteristics of such alternate materials are compatible with the required characteristics of the core members.

I claim:

1. Apparatus for winding a plurality of metal strips on a drum to form a plurality of coiled strips, comprising:

a. a substantially solid, non-collapsible drum formed with a plurality of longitudinally extending, circumferentially spaced slots in the periphery thereof;

b. rail members and interconnected wear members mounted in each of said slots, and means for biasing said rail and wear members radially inwardly to a position wherein the outer surface of each wear member is below the periphery of said drum;

c. core means positioned loosely around the periphery of said drum for receiving individual strips, and spacer means between said core means, said core means being rotatable on said drum;

d. an expansible, fluid-receiving means positioned in each slot radially inwardly of said rail, and e. a fluid control system operatively connected to each of said fluid-receiving means for supplying fluid under pressure thereto, the fluid pressurization of said fluid-receiving means functioning to expand the same and force said rail and wear members radially outwardly into frictional contact with said core means thereby creating frictional torque, enabling to produce tension in said metal strips and consequent controlled tight winding of said strips on said core means, partial reduction of said fluid pressure permitting the tightly wound coiled strips on their respective cores to slip on said drum surface and the loosely wound coiled strips to continue rotation so as to remove the slack from such strips, whereby substantially uniformly tight wound coiled strips are formed.

2. The apparatus of claim 1 wherein said slots are generally inverted T-shaped in cross section, and said rail members are similarly relatively inverted T-shaped in cross section and carry at the radially outer ends said wear members, said rail and wear members when unstressed in the absence of fluid pressure application to said fluid-receiving means being positioned in said slot so that the outer surface of said wear member is within the periphery of said drum and out of contact with said core means.

3. The apparatus of claim 2 wherein said means for biasing said rail and wear members radially inwardly comprises grooves formed in said rail members adjacent the bottom of the stem portions thereof, said grooves being constricted during the application of fluid pressure to said fluid-receiving means, said construction creating a radially inward force on said rail means serving to return the same and said wear members to an unstressed position following cessation of the fluid pressure.

4. The apparatus of claim 1 wherein said means for biasing said rail and wear members radially inwardly comprises springs means extending around said drum and positioned in transverse grooves formed in said drum and said rail and wear members relatively adjacent the periphery of said drum.

5. The apparatus of claim 2 wherein said generally T-shaped slots are formed by providing rectangular shaped slots in the periphery of said drum and arcuate segments secured to said drum between said slots, the outer curved surface of said segments corresponding to the curvature of said drum surface, and the ends of said segments extending into said rectangular slots to define said generally T-shaped slots.

6. The apparatus of claim 1 wherein said core means comprises individual core members positioned loosely around the surface of said drum, said core members being less in width than the width of said metal strip carried by said cores, annular spacing members interposed between said core members, said spacing members being somewhat smaller in outside diameter than the outside diameter of said core members and being somewhat larger in internal diameter than the internal diameter of said core members.

7. The apparatus of claim 1 wherein said core means includes individual annular core members loosely positioned around said drum, said core members being approximately equal in width to the width of said metal strips carried thereby, and wherein said spacer means comprise relatively thin, disc-like members interposed between said core members and extending radially outwardly from the drum surface, with the coiled strip on each core member being bounded by said spacers.

8. Apparatus of claim 1 further including an annular end ring mounted at one end of said drum and including a radially extending flange for retaining the end strip in place on said drum, with the coiled strip at the opposite end of said drum being retained by an annular stripper means secured in place around said drum by a plurality of lugs.

9. The apparatus of claim 1 wherein said fluid control system includes a source of hydraulic fluid, pump means for pumping said fluid through said system, and pressure regulating valves for regulating the pressure of said fluid supplied to said fluid-receiving means, said pressure regulator valves serving to maintain full pressure in said fluid-receiving means whereby said rail and wear members frictionally engage said core means, reduced pressure which permits certain of said core means to rotate on said drum relative to other of said core means, and a total absence of pressure whereby said rail and wear members are biased inwardly out of contact with said core means thereby to permit rotation of said core means relative to said drum.

10. The apparatus of claim 9 wherein said expansible, fluid-receiving means comprises expansible hoses positioned in said slot below said rail members, and means connecting said hoses to the fluid circulated by said fluid control system.

11. The apparatus of claim 1 wherein said core means includes an annular, solid core member positioned loosely around said drum and having a tapered outer surface and a split core ring positioned around said solid core member, said split core ring having a gap being formed with a tapered inner surface for mating engagement with the tapered surface of said solid core member, the outer surface of said ring receiving the coiled strip.

12. The apparatus of claim 11 wherein said outer ring is formed with an annular groove in the bottom, tapered surface thereof, with the ends of such groove terminating adjacent to the ends of said split core ring, and means for supplying fluid under pressure to said groove whereby said solid core member can be forced laterally away from said split ring due to the tapered surface between such members, with the removal of said solid core member resulting in the closure of the gap in said split ring thus reducing the outside diameter of said split core member and freeing the same from the interior diameter of said coiled strip whereby both said solid core member and said split ring can be immediately recovered for reuse.

13. The apparatus of claim 1 wherein said rail members are constructed of flexible, relatively hard elastomeric material, and reinforcing means embedded in said rail members to rigidify the same, said reinforcing means being such as to not impair radial movement of the rail member relative to said drum.

14. The apparatus of claim 11 wherein said solid core member and said split core ring are smaller in width than the strip to be wound thereon, and said spacer means comprises first spacer means extending radially from the drum for separating adjacently wound strip coils, and second spacer means positioned on each side of each of said first spacer means, the combined width of a pair of said second spacer means and said core member and said split core ring closely approximating the width of each strip, whereby the same width solid core member and split core ring can be employed with substantially varying strip widths by employing second spacer means of a preselected width.

15. Apparatus for winding a plurality of metal strips on a drum to form a plurality of coiled strips, comprising:

a. a drum formed with a plurality of longitudinally extending, circumferentially spaced slots in the periphery thereof;

b. core means positioned loosely around the periphery of said drum for receiving individual strips, and spacer means between said core means, said core means being rotatable on said drum;

c. an expansible, fluid-receiving hose means positioned in each slot, a section of said hose means being located adjacent to but spaced from said core means when said hose means is not inflated, and d. a fluid control system operatively connected to each of said hose means for supplying fluid under pressure thereto, the fluid pressurization of said hose means functioning to expand the same and force said section of said hose means radially outwardly into direct frictional contact with said core means thereby creating frictional torque and producing tension in said metal strips and consequent controlled tight winding of said strips and on said core means whereby substantially uniformly tight wound coiled strips are formed.

16. The apparatus of claim 15 wherein said section of said hose means which directly contacts said core means comprises a thickened boot which extends through an opening formed in said drum contact with said core means when said hose means is inflated.

17. The apparatus of claim 16 wherein said hose means is further formed with additional boots spaced circumferentially around said hose means, whereby said hose means can be periodically rotated to present a different boot through said slot in said drum for contact with said core means.

18. The apparatus of claim 17 wherein said slot in said drum is enlarged adjacent said core means to facilitate radial movement of said boot which is disposed adjacent said core means.

19. The apparatus of claim 15 wherein said hose means is formed on the exterior surface thereof with a series of ribs and said slot in said drum is formed with an interfitting series of ribs, whereby rotation of said hose means relative to said drum is precluded while permitting said hose means to be removed and rotated so as to present a new series of ribs for contact with said core means.

20. The apparatus of claim 15 wherein said hose means includes a solid end member having a fluid pressure line embedded therein and a blind end member, the latter being fixedly secured to said drum for preventing rotation thereof in said slot.

21. The apparatus of claim 15 wherein said hose means is a smooth cylindrical hose positioned in a semicylindrical slot formed in the periphery of said drum, said hose extending radially from said slot for engagement with said core means when inflated, and bar members positioned between said hoses and secured to said drum, said bar members having curved sides shaped to conform to the radius of said semicylindrical slot and an outer curved surface conforming to the shape of said core means, adjacent bar members being spaced to provide an opening therebetween through which said hose can extend when inflated for frictional contact with said core means.

22. The apparatus of claim 1 wherein said core means comprises a plurality of individual core members positioned loosely around the surface of said drum, the core members supporting the marginal metal strips being of slightly larger outside diameter than the core members supporting the median metal strips so as to effect slippage of the cores supporting the marginal metal strips relative to the core members supporting the median metal strips.

23. Apparatus of claim 15 wherein said core means comprises a plurality of individual core members positioned loosely around the surface of said drum, the core members supporting the marginal metal strips being of slightly larger outside diameter than the core members supporting the median metal strips so as to effect slippage of the cores supporting the marginal metal strips relative to the core members supporting the median metal strips.

* * * * *